US007269882B2

(12) United States Patent
Kato

(10) Patent No.: US 7,269,882 B2
(45) Date of Patent: Sep. 18, 2007

(54) WRISTWATCH AND FASTENING DEVICE FOR FASTENING BAND TO CASE OF WRISTWATCH

(75) Inventor: Teruo Kato, Chiba (JP)

(73) Assignee: Seiko Instruments Inc. (JP)

( * ) Notice: Subject to any disclaimer, the term of this patent is extended or adjusted under 35 U.S.C. 154(b) by 161 days.

(21) Appl. No.: 11/007,436

(22) Filed: Dec. 8, 2004

(65) Prior Publication Data

US 2005/0150086 A1 Jul. 14, 2005

(30) Foreign Application Priority Data

Dec. 24, 2003 (JP) ..... 2003-427351

(51) Int. Cl.
*G04B 37/16* (2006.01)

(52) U.S. Cl. ..... 24/265 WS; 368/282

(58) Field of Classification Search ..... 24/265 WS, 24/265 B; 368/281, 282; 224/717, 173, 224/164, 177, 168
See application file for complete search history.

(56) References Cited

U.S. PATENT DOCUMENTS 6,200,018 B1 * 3/2001 Dubugnon et al. ..... 368/281
2003/0002394 A1 * 1/2003 Kinkio et al. ..... 368/281

FOREIGN PATENT DOCUMENTS

JP 200033004 2/2000

* cited by examiner

*Primary Examiner*—James R Brittain
(74) *Attorney, Agent, or Firm*—Adams & Wilks

(57) ABSTRACT

To provide a wristwatch in which a band can be easily attached to and detached from a case band without damaging the case band. A wristwatch in which a band is attached to a case bandvia connection pieces includes fixing surfaces, fixing screws, attachment holes, and projections. A bow crotch for releasably receiving the connection piece is formed between bow legs of the case band. The fixing surface provided on the back of the corresponding bow leg is squarely folded along a side of the bow leg opposed to the connection piece and extends in an inclination. The fixing screw is threaded into the connection piece from its back. The fixing screw has a head having such a shape as to be disposed throughout the fixing surfaces in tight contact therewith when the threading is completed and is positioned within the width of the connection piece when the threading is loosened. The attachment hole inclined in a direction opposite to the inclination of the fixing surface is provided on a portion of the case band facing to the bow crotch. The projection 18 releasably engaging with the attachment hole is provided on an end surface of the connection piece facing to the bow crotch.

18 Claims, 4 Drawing Sheets

WRISTWATCH AND FASTENING DEVICE FOR FASTENING BAND TO CASE OF WRISTWATCH

BACKGROUND OF THE INVENTION

1. Field of the Invention

The present invention relates to a wristwatch in which a band is releasably attached to a case band.

2. Description of the Prior Art

In a known wristwatch, band ends are connected to two-forked bow legs provided at portions of a case band corresponding to 6 and 12 of a dial via connection pieces. For the purpose of this connection, the top piece (connection pieces) attached to the band end has a through hole extending in its lateral (width) direction, while a couple of the bow legs between which a bow crotch for receiving the top piece is formed each have an attachment hole. An expandable and contractible spring bar provided with an end shaft having a spring force in a projecting direction at each of its ends in the shaft direction is included, and the band is connected to the case band by inserting the spring bar into the top piece and also by inserting both the end shafts of the spring bar into the corresponding attachment holes of the bow legs. (The wristwatch having this structure is disclosed in JP-A-2000-33004 (paragraphs 0018 through 0022, FIGS. 1 through 4), for example.).

According to a conventional example, the end shafts of the spring bar inserted into the attachment holes of the bow legs are required to be shifted in opposition to the strong spring force to separate the end shafts from the attachment holes of the bow legs by inserting a special-purpose tool into a space between the bow legs and a concave formed in the connection piece when it is desired to release the connection between the band and the case band, which is inconvenient for a user. Conversely, the above specialized tool is also used to handle the spring bar when the wristwatch is assembled or when the user attaches the band to the case band, which is inconvenient similarly. In addition, the shaft ends of the spring bar have a force in the projecting direction as described above. Thus, if the tips of the shaft ends of the spring bar happen to rub against the bow leg of the case band at the time of attachment of the band by the user, there is a possibility of damaging the case band.

It is an object of the present invention to provide a wristwatch in which a band can be easily attached to and detached from a case band without damaging the case band.

SUMMARY OF THE INVENTION

A wristwatch in which a band is attached to a case band via connection pieces in the present invention comprises as first means for solving the above problem: fixing surfaces each of which is provided on a back of a corresponding bow leg and folded along a surface of the bow leg opposed to the connection piece to extend with an inclination in a longitudinal direction of the bow leg, a bow crotch for releasably receiving the connection piece being formed between the bow legs provided on the case band; fixing screws each of which is threaded into the connection piece from its back and has a head having such a shape as to be disposed throughout the fixing surfaces in tight contact therewith when the threading is completed and be positioned within the width of the connection piece when the threading is loosened; attachment holes each of which is inclined in a direction opposite to the inclination of the fixing surface and is provided on either a portion of the case band facing to the bow crotch or the connection piece; and projections each of which is provided on the other of the portion of the case band facing to the bow crotch and the connection piece and releasably engages with the attachment hole.

According to the invention, the connection piece can be attached to the case band by the procedures of: fitting the connection piece connected with the band into the bow crotch of the case band while bringing the attachment hole formed on either the case band or the connection piece into engagement with the projection formed on the other of the case band and the connection piece; and subsequently tightening the fixing screw already threaded into the connection piece from its back such that the head of the fixing screw tightly contacts the fixing surfaces on the backs of the bow legs. Conversely, the connection piece connected with the band can be removed from the case band by the procedures of: loosening the fixing screw to separate the head of the fixing screw from the fixing surfaces and dispose the head within the width of the connection piece; and subsequently detaching the connection piece from the bow crotch while releasing the engagement between the attachment hole and the projection. Therefore, according to the present invention, the band can be attached to and detached from the case band without using a spring bar which is expanded and contracted by a special-purpose tool as apparent from the above description.

A wristwatch in which a band is attached to a case band via connection pieces in the present invention comprises as second means for solving the above problem: fixing surfaces each of which is provided on a back of a corresponding bow leg and folded along a surface of the bow leg opposed to the connection piece to extend with an inclination in a longitudinal direction of the bow leg, a bow crotch for releasably receiving the connection piece being formed between the bow legs provided on the case band; fixing screws each of which is releasably threaded into the connection piece from its back and has a head so sized as to be disposed throughout the fixing surfaces in tight contact therewith when the threading is completed; attachment holes each of which is inclined in a direction opposite to the inclination of the fixing surface and is provided on either a portion of the case band facing to the bow crotch or the connection piece; and projections each of which is provided on the other of the portion of the case band facing to the bow crotch and the connection piece and releasably engages with the attachment hole.

According to the invention, the connection piece can be attached to the case band by the procedures of: fitting the connection piece connected with the band into the bow crotch of the case band while bringing the attachment hole formed on either the case band or the connection piece into engagement with the projection formed on the other of the case band and the connection piece; and subsequently tightening the fixing screw while threading the fixing screw into the connection piece from its back such that the head of the fixing screw tightly contacts the fixing surfaces on the backs of the bow legs. Conversely, the connection piece connected with the band can be removed from the case band by the procedures of: loosening the fixing screw to separate the fixing screw from the connection piece; and subsequently detaching the connection piece from the bow crotch while releasing the engagement between the attachment hole and the projection. Therefore, according to the present invention, the band can be attached to and detached from the case band without using a spring bar which is expanded and contracted by a special-purpose tool as apparent from the above description.

In a preferred example of the present invention, a notch which is open to both the bow crotch and the back is provided on each back of the bow legs. The fixing surface is formed by the inner surface of the notch. The depth of the notch is larger than the thickness of the head. This example is desirable since contact between the head of the fixing screw and the wrist of the user is avoided so as to prevent degradation of wearing comfortableness.

In a preferred example of the present invention, an annular packing is provided between the attachment hole and the projection inserted into the attachment hole. This example is desirable since looseness of the connection piece is prevented with the band attached to the case band.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

An embodiment of the present invention is hereinafter described in conjunction with FIGS. 1 through 4.

Figure 1:
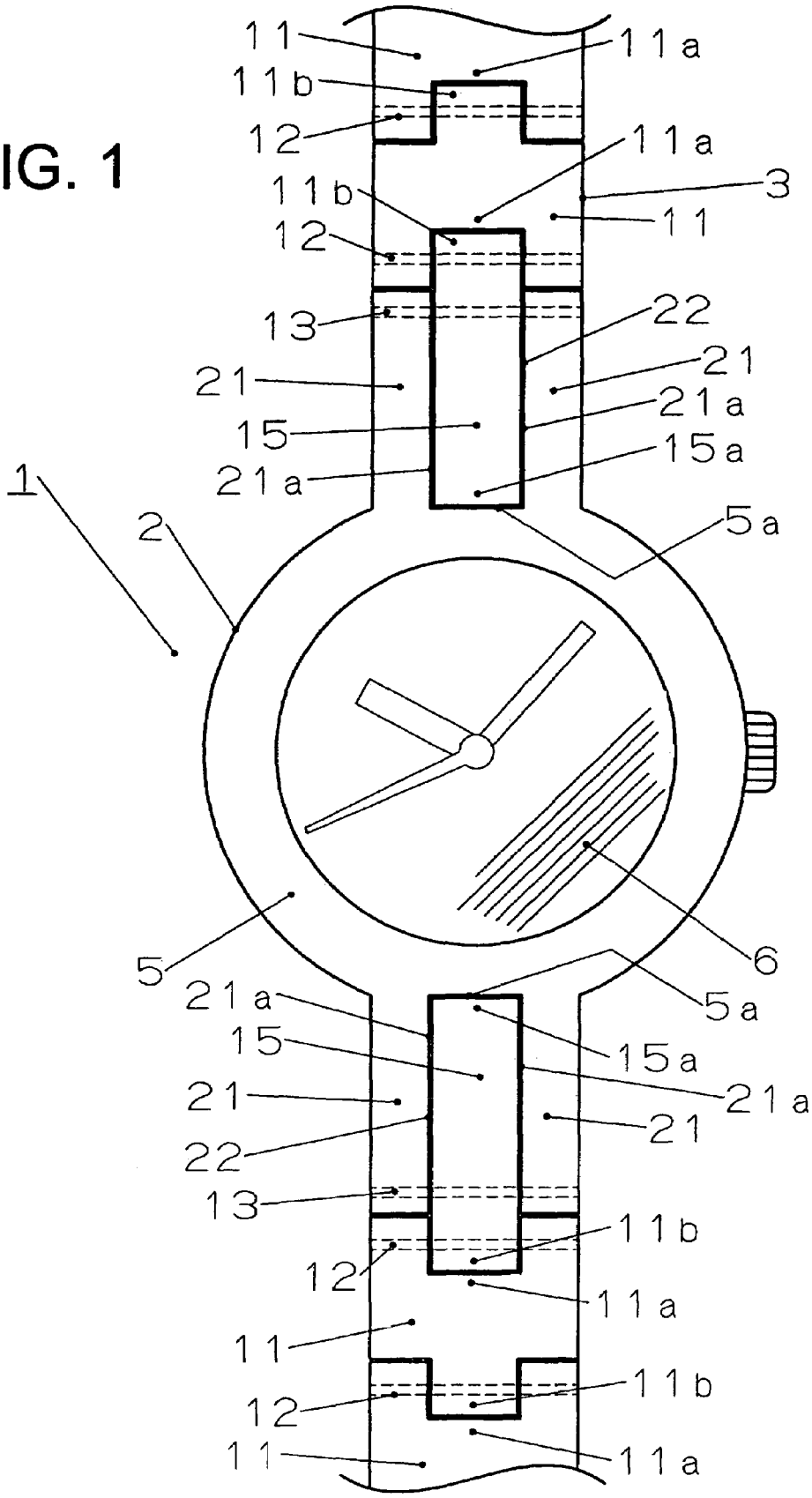
FIG. 1 is a plan view illustrating a wristwatch in an embodiment according to the present invention.

A wristwatch 1 illustrated in FIG. 1 has a band 3 attached to a watch casing assembly 2. In the watch casing assembly 2, a cover glass 6 through which a dial is visually recognizable is attached to the front of a case band 5, while a case back 7 illustrated in FIGS. 2B and 3B is screwed into the back of the case band 5. The dial, a not-shown watch movement and other components are accommodated within the watch casing assembly 2.

As illustrated in FIG. 1, the band 3 is releasably attached to the case band 5 of the watch casing assembly 2 at portions corresponding to 6 and 12 of the dial. The band 3 includes a plurality of band pieces 11 each of which has a concave 11*a* and a convex 11*b*, for example. The adjoining band pieces 11 are connected by the engagement between the adjoining concave 11*a* and the convex 11*b*. The respective engagement portions are connected by means of bar-shaped piece connection members 12 inserted through the band 3 in a band width direction in such a manner as to be rotatable around the piece connection members 12. The band 3 is not limited to a structure formed by a plurality of the band pieces 11 connected with each other as described herein, but may be made of other material such as synthetic resin and leather which is formed into a belt shape.

A connection piece 15 is attached to each end of the band 3 positioned on the side of the watch casing assembly 2. More specifically, the connection piece 15 is made of metal, for example, and has a rectangular shape in a plan view as illustrated in FIG. 1. One end of the connection piece 15 in its longitudinal direction engages with the concave 11*a* of the band piece 11 disposed at the end of the band 3 to be connected with the band piece 11 disposed at the end of the band 3 by inserting a bar-shaped piece connection member 13 through this engagement portion in the width direction of the band 3. The piece connection member 13 is a similar component to the above-described piece connection member 12, and the connection piece 15 and the band piece 11 connected thereto are rotatable around the piece connection member 13. A reference numeral 16 in FIGS. 2A and 2B and FIGS. 3A and 3B denotes a through hole through which the piece connection member 13 is inserted.

Figure 2A:
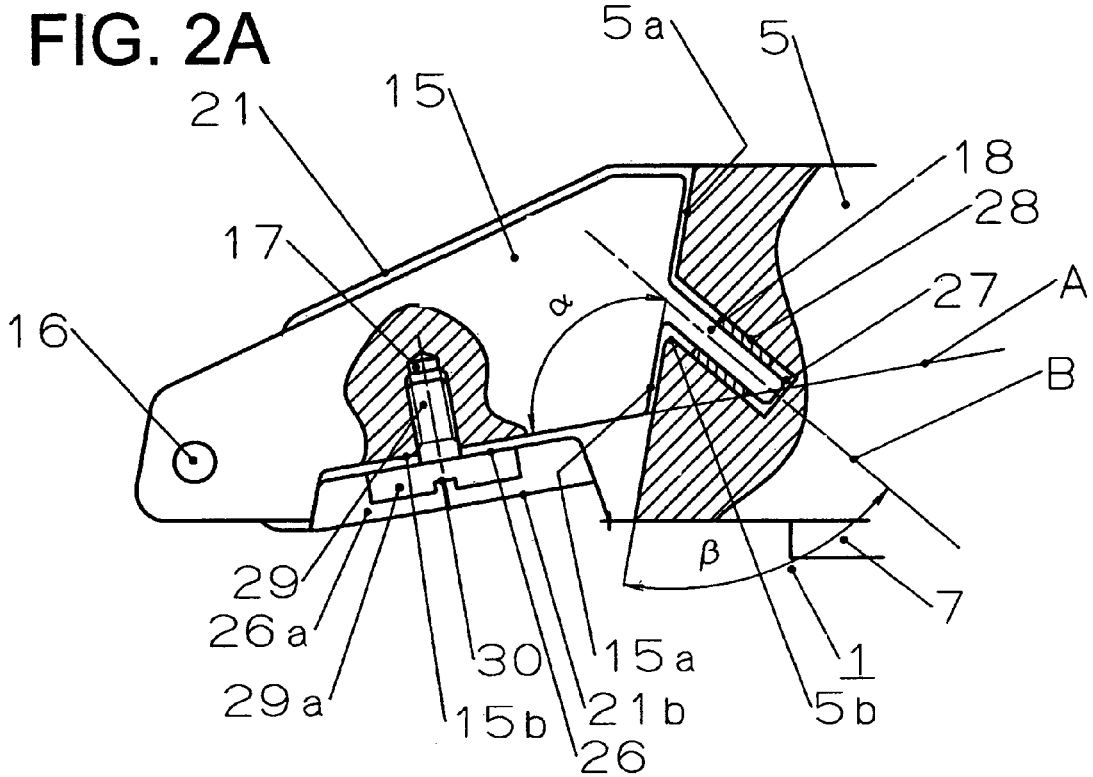
FIG. 2A is a cross-sectional view illustrating a structure of a connection piece connected to a case band included in the wristwatch shown in FIG. 1 in a condition where the connection piece is fixed.
Figure 2B:
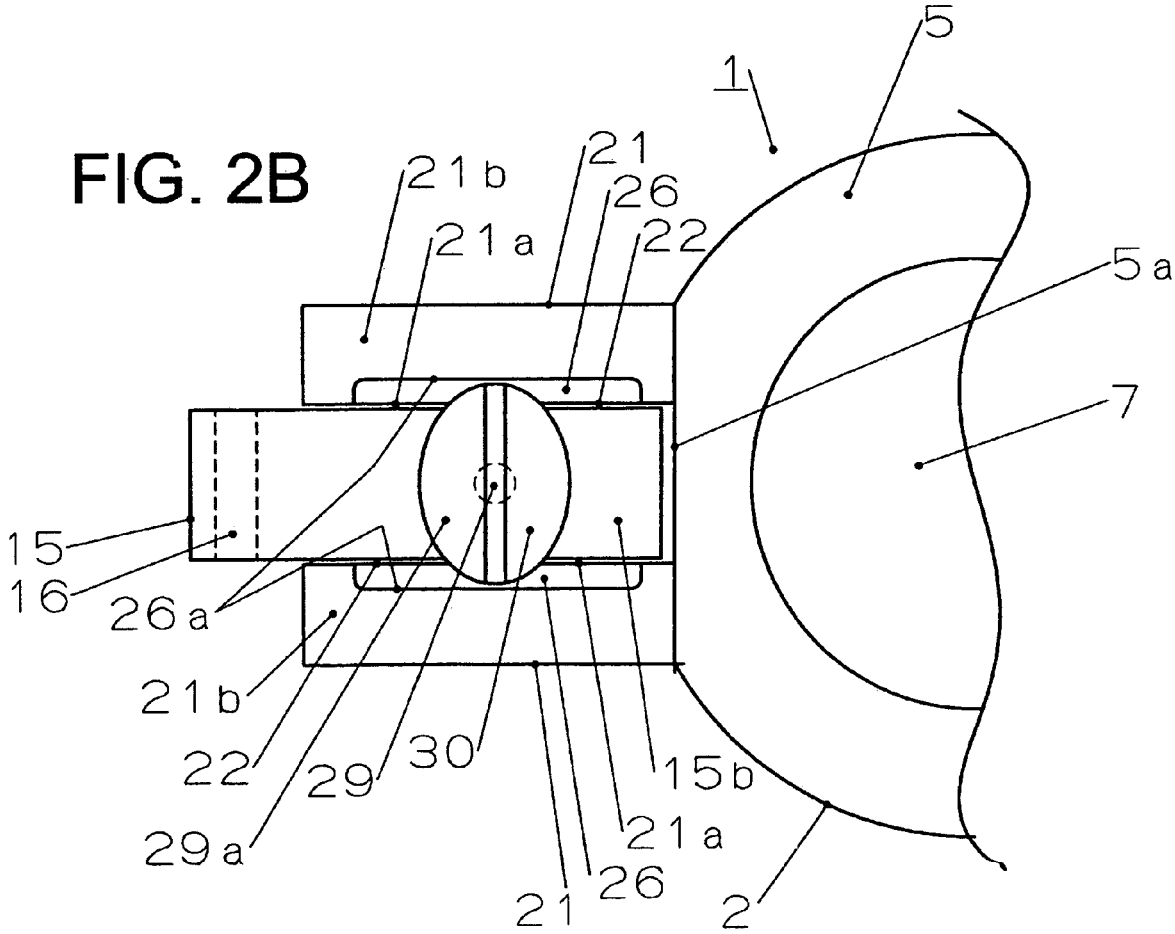
FIG. 2B is a back view illustrating the structure of the connection piece connected to the case band included in the wristwatch shown in FIG. 1 in the condition where the connection piece is fixed.
Figure 3A:
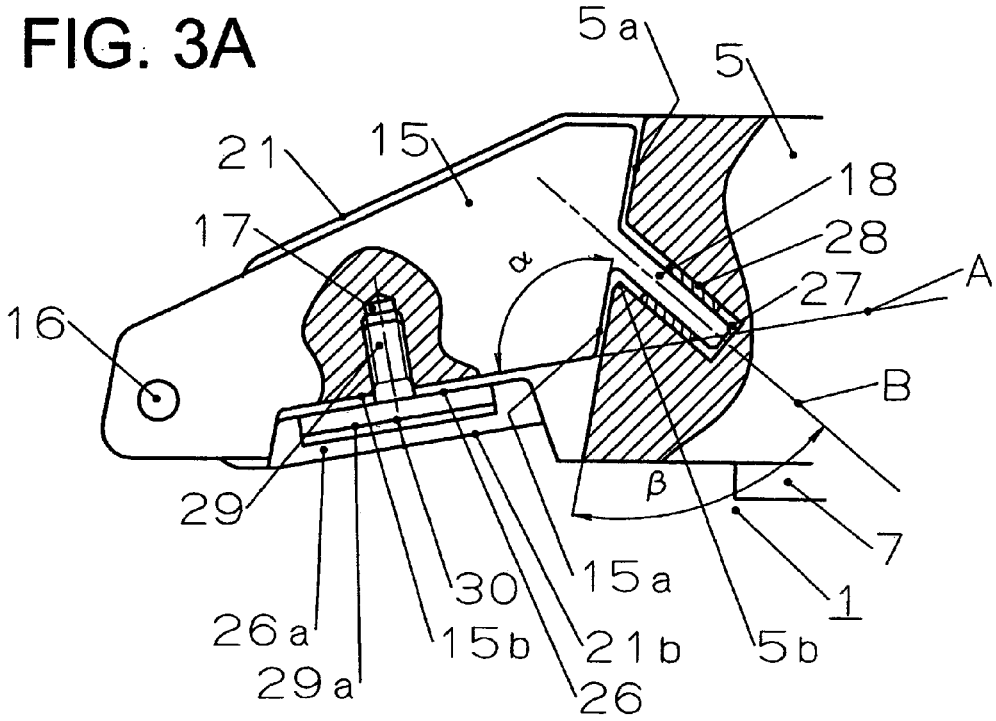
FIG. 3A is a cross-sectional view illustrating the structure of the connection piece connected to the case band included in the wristwatch shown in FIG. 1 in a condition where the fixing of the connection piece is released.
Figure 3B:
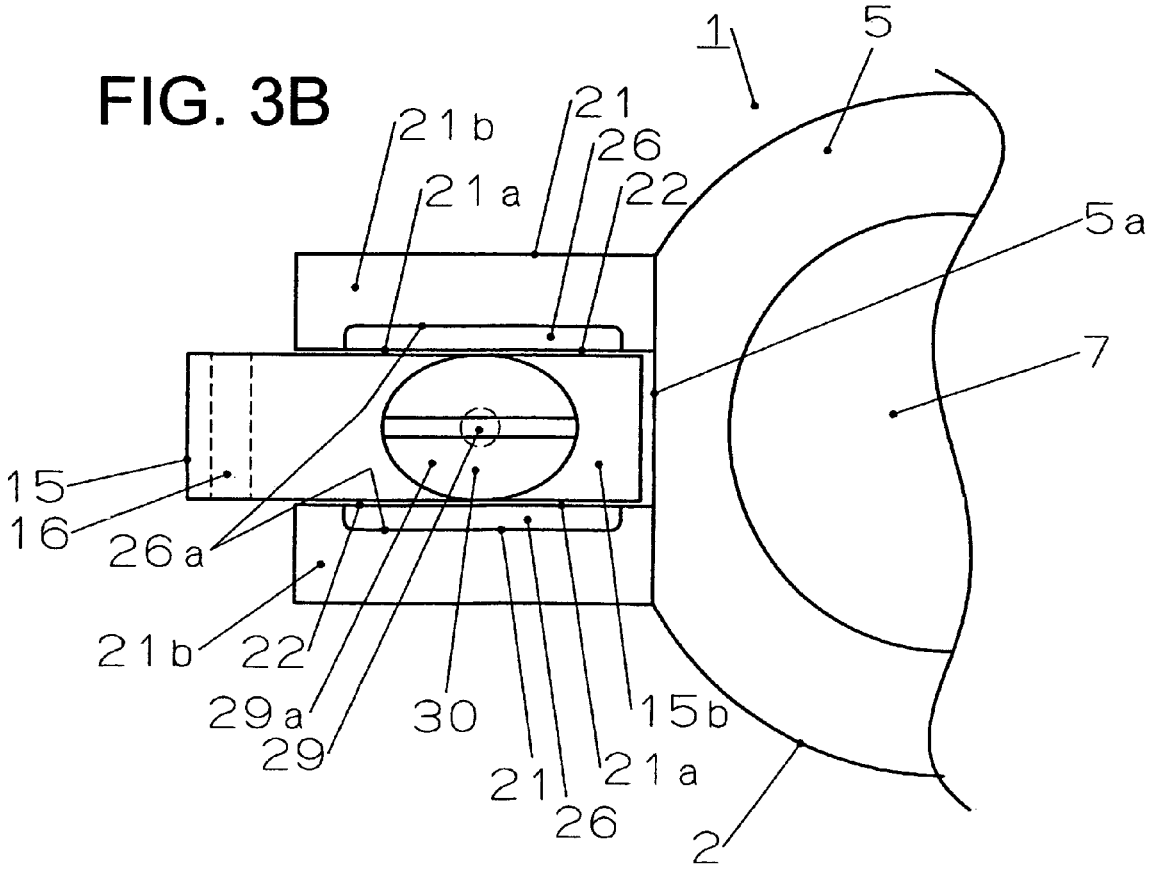
FIG. 3B is a back view illustrating the structure of the connection piece connected to the case band included in the wristwatch shown in FIG. 1 in the condition where the fixing of the connection piece is released.

As illustrated in FIGS. 2A and 3A, an end surface 15*a* of the connection piece 15 and an inclined back 15*b* connecting with the end surface 15*a* form an obtuse angle $\alpha$. The end surface 15*a* of the connection piece 15 functions as an opposite surface described later. The connection piece 15 has the maximum thickness at the end surface 15*a*. This thickness is smaller than the thickness of a case band outside surface 5*a* described later which functions as another opposite surface opposed to the end surface 15*a*. The connection piece 15 has a fixing screw hole 17 which is formed from its back 15*b*. The fixing screw hole 17 extends in a normal direction of the back 15*b*.

The case band 5 of the watch casing assembly 2 is made of metal, for example. A pair of bow legs 21 are formed integrally with the case band 5 at respective portions corresponding to 6 and 12 of the dial. A bow crotch 22 as a spacing is formed between a pair of the bow legs 21. More specifically, the bow crotch 22 for releasably receiving the connection piece 15 is formed by sides 21*a* of a pair of the bow legs 21 parallel to each other and the case band outside surface 5*a* provided between a pair of the bow legs 21 and to connect with the sides 21*a*. The sides 21*a* are surfaces opposed to sides of the connection piece 15 received by the bow crotch 22. The case band outside surface 5*a* facing to the bow crotch 22 is a flat surface opposed to the end surface 15*a* of the connection piece 15 received by the bow crotch 22, and is inclined vertically or almost vertically as illustrated in FIGS. 2A and 3A.

A back 21*b* of each bow leg 21 is a slope which gradually lowers from the root to the top of the bow leg 21. The back 21*b* has a flat fixing surface 26 which is squarely folded along the side 21*a*. More specifically, in a preferred example of this embodiment, a notch 26*a* which opens to the bow crotch 22 and the back 21*b* and extends in a longitudinal direction of the bow leg 21 is provided on the back 21*b* of the bow leg 21 as illustrated in FIGS. 2A, 2B, 3A and 3B. The fixing surface 26 is formed by the inner surface of the notch 26*a*. The fixing surface 26 extends in the longitudinal direction of the bow leg 21 with an inclination of lowering toward the top of the bow leg 21 to be disposed substantially parallel to the back 15*b* of the connection piece 15, for example.

The case band 5 has a bottomed circular attachment hole 27 which opens to the case band outside surface 5*a* facing to the bow crotch 22. The inclination of the attachment hole 27 is opposite to the inclination of the back 21*b* of the bow leg 21, more precisely, the inclination of the fixing surface 26. That is, the attachment hole 27 is so inclined as to approach the case back 7 from its opening toward the bottom (inside). Thus, as illustrated in FIGS. 2A and 3A, the fixing surface 26 and the attachment hole 27 are disposed in such positions that an axis extension line A of the attachment hole 27 and an extension line B of the fixing surface 26 cross each other within the watch casing assembly 2. In this embodiment in which the case band outside surface 5*a* is directed almost vertically, providing the attachment hole 27 along a normal direction of the case band outside surface 5*a*, i.e., providing the attachment hole 27 substantially parallel to the cover glass 6 or the case back 7 is excluded to satisfy the above-described crossing relationship. As a result, an angle β formed by the case band outside surface 5*a* and the axis extension line A of the attachment hole 27 is acute, and the attachment hole 27 opens to the case band outside surface 5*a* in an oblique direction. The angle β is preferably established in a range of (60±20)°, for example. It is more preferable to determine the angle β in a range of (60±5)° for securing a mechanical strength of an acute-angled case band portion 5*b* having the above-described angle β by providing a sufficient wall thickness for the case band portion 5*b* and for facilitating insertion of a projection 18 described later into the attachment hole 27.

A cylindrical packing 28 accommodated in the attachment hole 27 is bonded to the inside surface of the attachment hole 27 by adhesive. The packing 28 is made of elastically deformable material such as rubber.

A projection 18 which projects diagonally downward to releasably engage with the attachment hole 27 is disposed at a central portion of the end surface 15*a* of the connection piece 15 in its thickness direction. The projection 18 has a cylindrical shape corresponding to the hole configuration of the attachment hole 27. The projection 18 is tightly inserted into the inside of the packing 28 while elastically deforming the packing 28. The shapes of the projection 18 and the attachment hole 27 are not limited to cylindrical or round, but may be other shapes as long as they correspond to each other, such as a plate or other shape and a hole shape identical or similar thereto.

The connection piece 15 having the projection 18 which is inserted into the attachment hole 27 is housed in the bow crotch 22 between the bow legs 21, and is releasably connected to the case band 5 by means of a fixing screw 29 which is threaded into the fixing screw hole 17 of the connection piece 15 from its back. A head 29*a* of the fixing screw 29 has a shape such as an ellipse so as to be positioned throughout the fixing surfaces 26 of a pair of the bow legs 21 in tight contact with the fixing surfaces 26 when the threading is completed as illustrated in FIGS. 2A and 2B and also to be positioned within the width of the connection piece 15 when the threading is loosened as illustrated in FIGS. 3A and 3B.

The thickness of the head 29*a* is smaller than the depth of the notch 26*a*, and thus the head 29*a* of the fixing screw 29 is positioned above the back 21*b* of the bow leg 21. As a result, the head 29*a* does not contact the wrist of the user when the wristwatch 1 is attached thereto, thereby preventing degradation of the wearing comfortableness. When the back 21*b* of the bow leg 21 is positioned sufficiently above the case back 7, the back 21*b* of the bow leg 21 itself can function as the fixing surface and the head 29*a* of the fixing screw 29 can be disposed within the range between the back 21*b* and the case back 7. Accordingly, the degradation of the wearing comfortableness caused by the head 29*a* can be prevented.

The head 29*a* has an operation groove 30 in the shape of minus (−) or plus (+). The operation groove 30 has a structure capable of receiving a driver of a common type. In a particular example of this embodiment, the operation groove 30 has a minus (−) shape which is capable of receiving a periphery of a coin. The head 29*a* may have another configuration such as a rhomb and a rectangle having major and minor axes.

Next, the procedures for connecting the connection piece 15 attached to the end of the band 3 with the watch casing assembly 2 are described.

The fixing screw 29 is already threaded into the connection piece 15 from its back. The head 29*a* of the fixing screw 29 is positioned within the width of the connection piece 15 without sticking out from both ends of the connection piece 15 in its width direction by disposing the major and minor axes of the head 29*a* along the longitudinal and the width directions of the connection piece 15, respectively.

The connection piece 15 in this condition is fitted into the bow crotch 22 between the opposed bow legs 21 by moving the connection piece 15 diagonally downward while inserting the projection 18 of the connection piece 15 into the attachment hole 27 of the case band 5 from diagonally above. The head 29*a* of the fixing screw 29 in this condition does not obstruct the fitting. The fitting depth of the connection piece 15 into the bow crotch 22 is limited by the condition where the end surface 15*a* of the connection piece 15 contacts with or is opposed to the case band outside surface 5*a* with an extremely short distance therebetween when the projection 18 is sufficiently inserted into the attachment hole 27. Thus, the end surface 15*a* and the case band outside surface 5*a* function as surfaces opposed to each other. The connection piece 15 is so positioned as to be sandwiched between both sides of the bow legs 21 in the width direction in such a condition that the inclined back 15*b* is disposed slightly above the similarly inclined fixing surface 26. This condition is illustrated in FIGS. 3A and 3B.

Subsequently, the fixing screw 29 threaded into the back of the connection piece 15 is rotated in a tightening direction. The rotating operation is carried out by means of a coin, for example, whose edge is inserted into the operation groove 30 of the head 29*a*, or by a driver of a common type. In other words, the rotating operation can be conducted without using a special-purpose tool.

When threading of the fixing screw 29 by the rotating operation in the tightening direction is finished, the major axis of the head 29*a* comes to coincide with the width direction of the connection piece 15 at this stage with each end of the head 29*a* in the longitudinal direction projecting from the connection piece 15. These projecting portions allow the head 29*a* to be positioned throughout the fixing surfaces 26 forming the bottoms of the notches 26*a*, and to tightly contact the fixing surfaces 26 to secure the connection piece 15 to the case band 5. The secured condition is shown in FIGS. 2A and 2B.

The connection piece 15 secured to the case band 5 by the above-described procedures receives external forces from various directions via the band 3 and so forth. However, the connection piece 15 does not separate from the case band 5.

Figure 4A:
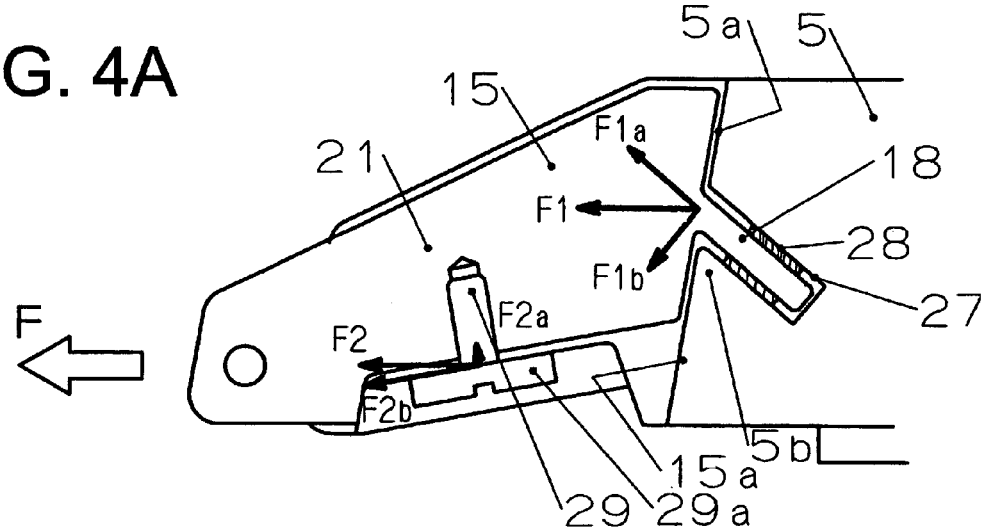
FIGS. 4A through 4C show forces in relation to external forces from different directions in the condition where the connection piece is fixed to the case band included in the wristwatch in FIG. 1.

More specifically, when a pull force F substantially parallel to the cover glass 6 and the case back 7 acts on connection piece 15 as illustrated in FIG. 4A, the pull force F provides a force F1 at the engagement portion between the projection 18 and the attachment hole 27 and a force F2 at a tight contact portion between the head 29*a* of the fixing screw 29 and the fixing surfaces 26. The force F1 can be divided into a divisional force F1*a* directed diagonally upward to the left as viewed in FIG. 4A along the axis direction of the projection 18 and a divisional force F1*b* perpendicular to the divisional force F1*a* and directed diagonally downward to the left as viewed in FIG. 4A. On the other hand, the force F2 can be divided into a divisional force F2*a* directed almost directly above as viewed in FIG. 4A along the axis direction of the fixing screw 29 and a divisional force F2*b* directed diagonally downward to the left as viewed in FIG. 4A, i.e., along the fixing surface 26 toward the top of the bow leg 21.

The divisional forces F1*b* and F2*b* oppose the divisional force F1*a* which urges the projection 18 to separate from the attachment hole 27. Moreover, the movement of the connection piece 15 diagonally upward to the left as viewed in FIG. 4A is prevented by the engagement between the fixing surfaces 26 and the head 29*a* of the fixing screw 29. Furthermore, a frictional force produced on the fixing surfaces 26 in opposition to the divisional force F2*b* and the engagement between the projection 18 and the acute-angled case band portion 5*b* formed by the case band outside surface 5*a* and the attachment hole 27 oppose the forces F1 and F2, thereby preventing the movement of the connection piece 15 in a pull direction by the pull force F. The anticlockwise rotation of the connection piece 15 due to the divisional force F2*a* as viewed in FIG. 4A is avoided by the contact between a lower portion of the end surface 15*a* of the connection piece 15 positioned below the root of the projection 18 and the case band outside surface 5*a* as well as by the engagement between the projection 18 and the attachment hole 27. Accordingly, the connection piece 15 does not separate from the case band 5 by the removal of the projection 18 from the attachment hole 27 caused by the pull force F.

When the attachment hole 27 and the projection 18 are disposed substantially parallel to the cover glass 6 or the case back 7 or parallel to the fixing surface 26, the pull force F is opposed chiefly by the frictional force produced on the fixing surface 26 in opposition to the divisional force F2*b*. Consequently, there is a possibility of removal of the projection 18 from the attachment hole 27 and thus separation of the connection piece 15 caused by the pulling of the connection piece 15 in the pull direction.

Figure 4B:
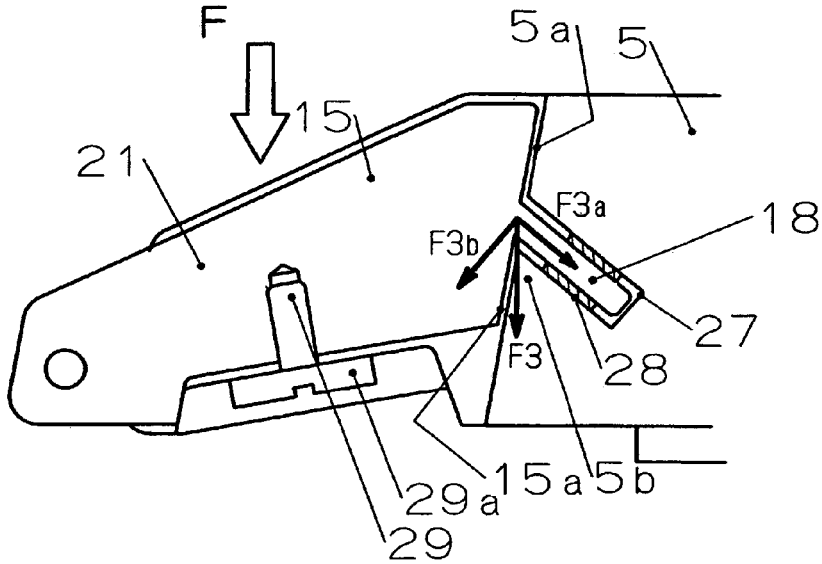

Additionally, when a push-down force F acts on the connection piece 15 (i.e., a pull-down force acts on the connection piece 15) as illustrated in FIG. 4B, the push-down force F provides a force F3 (F3=push-down force) acting on the engagement portion between the projection 18 and the attachment hole 27 with no resistance from the fixing screw 29 to the push-down force F. The force F3 can be divided into a divisional force F3*a* directed diagonally downward to the right as viewed in FIG. 4B along the axis direction of the projection 18, and a divisional force F3*b* directed diagonally downward to the left as viewed in FIG. 4B and perpendicular to the divisional force F3*a*.

Since the divisional force F3*a* urges the projection 18 to be inserted into the attachment hole 27, the projection 18 does not separate from the attachment hole 27 due to the divisional force F3*a*. The divisional force F3*b* urges the connection piece 15 to rotate anticlockwise as viewed in FIG. 4B. However, this rotation is prevented by the contact between the lower portion of the end surface 15*a* of the connection piece 15 and the case band 5*a* as well as the engagement between the projection 18 and the attachment hole 27. Consequently, the connection piece 15 does not separate from the case band 5 by the removal of the projection 18 from the attachment hole 27 due to the push-down force (pull-down force) F.

Figure 4C:
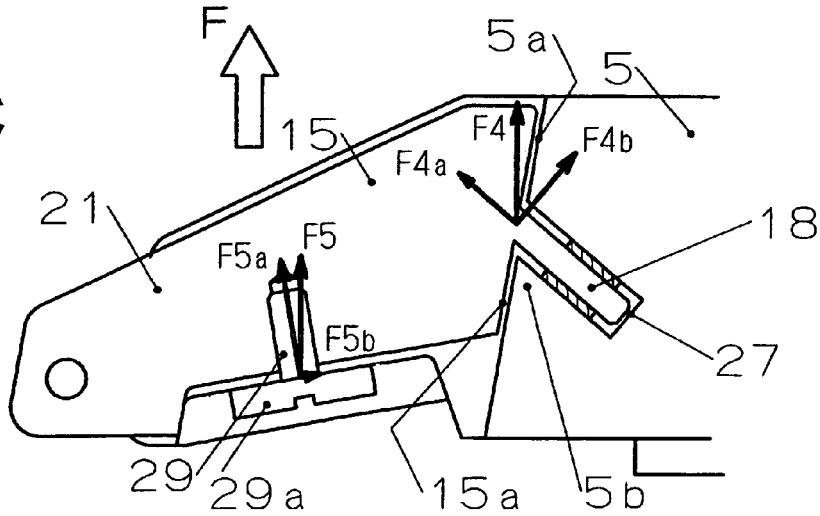

When a push-up force F acts on the connection piece 15 (i.e., a pull-up force acts on the connection piece 15) as illustrated in FIG. 4C, the push-up force F provides a force F4 acting on the engagement portion between the projection 18 and the attachment hole 27 and a force F5 acting on the tight contact portion between the head 29*a* of the fixing screw 29 and the fixing surfaces 26. The force F4 can be divided into a divisional force F4*a* directed diagonally upward to the left as viewed in FIG. 4C along the axis direction of the projection 18, and a divisional force F4*b* directed diagonally upward to the right as viewed in FIG. 4C and perpendicular to the divisional force F4*a*. On the other hand, the force F5 can be divided into a divisional force F5*a* directed almost directly above as viewed in FIG. 4C along the axis direction of the fixing screw 29, and a divisional force F5*b* directed diagonally upward to the right as viewed in FIG. 4C, i.e., along the fixing surface 26 toward the case band outside surface 5*a*.

The divisional force F4*b* does not act in a direction for removing the projection 18 from the attachment hole 27. Since the divisional force F5*b* acts in such a manner as to push the connection piece 15 toward the case band outside surface 5*a*, the projection 18 does not separate from the attachment hole 27 due to the divisional force F5*b*. On the other hand, both the divisional force F4*a* and the divisional force F5*a* act in a direction for removing the projection 18 from the attachment hole 27. However, the movement of the connection piece 15 in a direction diagonally upward to the left as viewed in FIG. 4A is prevented by the engagement between the fixing surfaces 26 and the head 29*a* of the fixing screw 29. Accordingly, there is no possibility of the removal of the projection 18 from the attachment hole 27 and thus the separation of the connection piece 15 from the case band 5 due to the push-up force (pull-up force) F.

The connection piece 15 is supported by the case band outside surface 5*a* or the bow legs 21 in opposition to external forces in directions other than the above-described directions. Thus, the connection piece 15 does not separate from the case band 5 by the removal of the projection 18 from the attachment hole 27.

The connection piece 15 attached to the case band 5 by the above-described procedures does not accidentally come off by external forces as described hereinbefore. Additionally, since the packing 28 is provided between the projection 18 and the attachment hole 27 in this attachment condition, looseness of the connection piece 15 can also be avoided. The packing 28 may be attached to the periphery of the projection 18 by adhesive or other means rather than to the inner surface of the attachment hole 27.

Next, procedures for removing the connection piece 15 from the case band 5 for replacement of the band 3 or other reason are explained. First, the fixing screw 29 is rotated in a loosening direction to dispose the head 29*a* of the fixing screw 29 within the width of the connection piece 15 as illustrated in FIGS. 3A and 3B. In this condition, the head 29*a* of the fixing screw 29 is separated from the fixing surfaces 26, thereby releasing the fixing condition of the connection piece 15 which is brought about by the fixing screw 29. Subsequently, the connection piece 15 is shifted diagonally upward such that the end surface 15*a* of the connection piece 15 is separated from the case band outside surface 5*a*, and the projection 18 is removed from the attachment hole 27 while detaching the connection piece 15 from the bow crotch 22. The connection piece 15 can thus be separated from the case band 5.

In the wristwatch 1 as described above, the connection between the connection piece 15 and the case band 5 is provided not by means of a spring bar but by the engagement between the inclined projection 18 and the attachment hole 27 and the tight contact between the head 29*a* of the fixing screw 29 and the fixing surfaces 26 of the bow legs 21. Thus, the connection piece 15 of the band 3 can be attached to and detached from the case band 5 by the procedures as described above without using a special-purpose tool which is required for handling the spring bar if it is employed. As a result, the assembling efficiency for producing the wristwatch 1 is improved, and also attachment and detachment of the band 3 to and from the case band 5 by the user are facilitated without damaging the case band 5. Therefore, when the user prepares various types of bands, design variations of the wristwatch 1 for use can be offered by replacing the band with a desired one at appropriate timing.

In the embodiment as described above, the head 29*a* of the fixing screw 29 is so sized as to be disposed within the width of the connection piece 15. Thus, the connection piece 15 can be attached to and detached from the case band 5 with the fixing screw 29 attached to the connection piece 15. Accordingly, the fixing screw 29 is not required to be separated from the connection piece 15, preventing the loss of the fixing screw. Moreover, the required rotation amount of the fixing screw 29 is only 90 degrees, for example, which enhances the maneuverability.

The present invention is not limited to the embodiment described hereinbefore. For example, a flush screw or other having the round head 29*a* larger than the width of the connection piece 15 may be employed as the fixing screw 29. In this case, the connection piece 15 can be attached to the case band 5 by threading the fixing screw 29 into the connection piece 15 from its back 15*b* to dispose the head 29*a* throughout the fixing surfaces 26 of a pair of the bow legs 21 in tight contact therewith when the threading of the fixing screw 29 is completed. Conversely, the connection piece 15 can be inserted into and released from the bow crotch 22 by loosening the fixing screw 29 to remove the fixing screw 29 from the connection piece 15.

Additionally, in the present invention, the projection 18 may be projected diagonally upward from the case band outside surface 5*a*. In this case, the attachment hole 27 into which the projection 18 is inserted is provided on the connection piece 15 such that the attachment hole 27 is open at the central portion of the end surface 15*a* and that the hole inner part is positioned diagonally above the opening.

Moreover, in the present invention, the case band outside surface 5*a* may be an inclined surface which gradually approaches the center of the case band 5 toward the front of the case band 5 in its thickness direction, rather than the surface extending almost vertically. In this case, the attachment hole 27 open to the case band outside surface 5*a* or the projection 18 projecting from the case band outside surface 5*a* is provided along the normal direction of the inclined case band outside surface 5*a*.

According to the present invention, it is possible to provide a wristwatch in which a band can be easily attached to and detached from a case band by a user without damaging the case band, since the attachment and detachment of the band to and from the case band are handled without using a spring bar which is expanded and contracted by a special-purpose tool.

What is claimed is:

1. A fastening device for releasably fastening a band to a case of a wrist-wearable electronic device, the fastening device comprising:

a plurality of connection members for releasable connection between the band and the case;

a plurality of bow-shaped members integrally connected to and extending from the case, each of the bow shaped members having a pair of leg portions in spaced-apart relation to define a space therebetween for releasably receiving one of the connection members, each of the leg portions having a connecting surface disposed at an inclination relative to a longitudinal direction of the leg portion;

a plurality of threaded members each threadedly engageable with a threaded hole formed in a respective one of the connection members, each of the threaded members having a head portion for engagement with the connecting surfaces of the leg portions of a respective one of the bow-shaped members when the threaded member is in threaded engagement with the threaded hole of the connection member;

means defining a plurality of attachment holes formed in respective portions of the case, each of the attachment holes being inclined in a direction opposite to a direction of inclination of each connecting surface of the leg portions of the bow-shaped member when the connection member is positioned in the space between the leg portions; and a plurality of projections each integrally connected to a respective one of the connection members for releasable engagement with a respective one of the attachment holes.

2. A fastening device according to claim 1; wherein the portion of the case confronts the space disposed between the leg portions of the bow-shaped member when the connection member is positioned in the space between the leg portions.

3. A fastening device according to claim 2; wherein the head portion of each of the threaded members does not engage the connecting surfaces of the leg portions of the bow-shaped member when the threaded member is in a preselected loosened state relative to the attachment hole.

4. A fastening device according to claim 3; wherein each leg portion of each bow-shaped member has a notched portion opening into the space between the leg portions of the bow-shaped member, each of the notched portions having an inner surface forming the connecting surface of the leg portion and a depth larger than a thickness of the head of each threaded member.

5. A fastening device according to claim 4; wherein the notched portion extends in the longitudinal direction of the leg portion.

6. A fastening device according to claim 3; further comprising an annular packing positionable between each of the attachment holes and corresponding projection.

7. A fastening device according to claim 2; further comprising an annular packing positionable between each of the attachment holes and corresponding projection.

8. A fastening device according to claim 2; wherein each leg portion of each bow-shaped member has a notched portion opening into the space between the leg portions of the bow-shaped member, each of the notched portions having an inner surface forming the connecting surface of the leg portion and a depth larger than a thickness of the head of each threaded member.

9. A fastening device according to claim 8; wherein the notched portion extends in the longitudinal direction of the leg portion.

10. A fastening device according to claim 1; wherein each leg portion of each bow shaped member has a notched portion opening into the space between the leg portions of the bow-shaped member, each of the notched portions having an inner surface forming the connecting surface of the leg portion and a depth larger than a thickness of the head of each threaded member.

11. A fastening device according to claim 10; wherein the notched portion extends in the longitudinal direction of the leg portion.

12. A fastening device according to claim 1; further comprising an annular packing positionable between each of the attachment holes and corresponding projection.

13. A wrist-wearable electronic device comprising: a case; a timepiece movement housed in the case; a band connected to the case for releasably mounting the electronic device on a wrist of a user; and a fastening device according to claim 1 for releasably fastening the band to the case.

14. A wrist-wearable electronic device according to claim 13; wherein the wrist-wearable electronic device comprises a wristwatch.

15. A wrist-wearable electronic device comprising:

a casing assembly having a case and a pair of projecting members extending from opposite ends of the case, each projecting member having a pair of leg portions in spaced-apart relation to define a space therebetween, and the case having a pair of attachment holes each opening into the space between the leg portions of a respective one of the projecting members, wherein each leg portion of each of the projecting members has a connecting surface disposed at an inclination relative to a longitudinal direction of the leg portion, and wherein each of the attachment holes of the case is inclined in a direction opposite to a direction of inclination of the connecting surface of each leg portion of a respective one of the projecting members;

a band for mounting the electronic device to a user's wrist;

a pair of connection members releasably connected between the band and the casing assembly, each of the connection members being mounted in the space between the leg portions of a respective one of the projecting members and having a projection releasably disposed in a respective one of the attachment holes of the case; and fastening means for releasably fastening the connection members to a respective one of the projecting members of the case, the fastening means comprising a pair of threaded members each threadedly engageable with a threaded hole formed in a respective one of the connection members, each of the threaded members having a head portion for engagement with the connecting surfaces of the leg portions of a respective one of the projecting members when the threaded member is in threaded engagement with the threaded hole of the connection member.

16. A wrist-wearable electronic device according to claim 15; wherein the head portion of each of the threaded members does not engage the connecting surfaces of the leg portions of the respective one of the projecting members member when the threaded member is in a preselected loosened state relative to the attachment hole.

17. A wrist-wearable electronic device according to claim 16; wherein each leg portion of each projecting member has a notched portion opening into the space between the leg portions of the projecting member, each of the notched portions having an inner surface forming the connecting surface of the leg portion and a depth larger than a thickness of the head of each threaded member.

18. A wrist-wearable electronic device according to claim 15 wherein the wrist-wearable electronic device comprises a wristwatch.

* * * * *